US005099253A

United States Patent [19]

Archer

[11] Patent Number: 5,099,253

[45] Date of Patent: Mar. 24, 1992

[54] CONSTANT BEAMWIDTH SCANNING ARRAY

[75] Inventor: Donald H. Archer, Santa Barbara, Calif.

[73] Assignee: Raytheon Company, Lexington, Mass.

[21] Appl. No.: 431,800

[22] Filed: Nov. 6, 1989

[51] Int. Cl.[5] ..... H01Q 19/060; H01Q 3/260

[52] U.S. Cl. ..... 343/754

[58] Field of Search ..... 343/753, 754, 853, 824; 342/368

[56] References Cited

U.S. PATENT DOCUMENTS 3,911,442 10/1975 Hatch ..... 343/754
3,921,176 11/1975 Shanafelt et al. ..... 343/754
4,086,597 4/1978 Sinsky et al. ..... 343/754
4,348,678 9/1982 Thomas ..... 343/754
4,578,680 3/1986 Haupt ..... 343/703

FOREIGN PATENT DOCUMENTS 8809066 11/1988 European Pat. Off. ..... 343/754

*Primary Examiner*—Michael C. Wimer
*Assistant Examiner*—Peter Toby Brown
*Attorney, Agent, or Firm*—Richard M. Sharkansky

[57] ABSTRACT

An array antenna system producing beams with widths constant with scan angle. The antenna array is fed by a microwave lens. The beam ports of the lens are disposed along an arc displaced from the focal arc of the lens. The distance between the arc and the focal arm decreases from a maximum amount at the center of the lens to a minimum amount where the arc intersects the focal arc.

9 Claims, 2 Drawing Sheets

CONSTANT BEAMWIDTH SCANNING ARRAY

BACKGROUND OF THE INVENTION

This invention relates generally to radio frequency energy systems and more particularly to a system for selectively transmitting or receiving radio frequency energy in one of a plurality of directions.

In many radio frequency systems, it is desirable to transmit or receive signals in any one of a plurality of directions. For the sake of simplicity, only the receive case is discussed here, but all statements could equally well cover the transmit case. Often, the radio frequency system is in a fixed location and the desired signal at any given time could come from any angle within a range of angles relative to the antenna.

One known way to receive a signal selectively from any of a plurality of angles is by electronically "steering" an array antenna. The angle to which the antenna is "steered" is determined by appropriately combining the signal as received at each array element. Before combining the portion of the signal received at each element, an appropriate phase shift is introduced into each portion of the signal.

One way of providing the appropriate phase shift is by employing an electromagnetic lens. Each antenna array element is connected to an array port along the front wall of the lens. Beam ports are disposed along the back wall of the lens. When the antenna is used to receive signals, the receiver is connected to a selected beam port. As is known, the antenna array forms a high gain receive beam pointed in the selected direction.

A signal impinging on the antenna array is coupled through each antenna element to each array port. From each array port, a portion of the received signal propagates along a path through the lens to the beam port. At the beam port, then, the portions of the signal in the various paths are combined.

The portions of the signal combined at the beam port are shifted in phase relative to each other. This occurs because the length of the paths from the source to the beam port can be different. Each length difference is proportional to a phase difference, with the constant of proportionality being the wavelength of the signal.

As is known, the strength of the combined signal at the beam port depends on the angle from which the signal impinges on the antenna array. The walls of the lens along which the array ports and beam ports are disposed are curved. The radius of curvature of the back wall is selected such that the back wall is along the "focal arc" of the lens. Portions of a signal impinging on the antenna from any given angle travel along the various paths in the lens such that the portions of the signal in the various paths arrive all with essentially the same phase at one particular point along the focal arc. Since the portions of the signal are combined with the same phase, they will produce a maximum signal level at this particular point.

A beam port located at a point along the focal arc is deemed to receive signals from the angle that results in the maximum signal level. The beam port is thus said to correspond to an angle.

However, the signal received at a beam port represents not just the signals received from the corresponding angle, but also signals received from closely related angles. However, the signals received from closely related directions are attenuated more than signals from the specific angle. The further from the specific angle the signals come from, the greater is the attenuation. For this reason, the antenna array is said to form a receive beam. The angle from which the maximum signal level is received is said to be the "beam center". The beam has a "width" which covers all angles from which signals are received with less than 3 dB more attenuation than at the beam center. A signal falling within the beam will be attenuated so little that it is deemed to be received by the system.

To receive signals from any angle in a range of angles, enough beam ports are located along the focal arc such that a plurality of beams is formed. Every angle in the range is included in at least one of the beams. To selectively receive a signal from a particular direction, a receiver is connected to the beam port corresponding to a beam in that direction.

One drawback to this approach is that connecting one receiver to each beam port can be very expensive. Even if one receiver is used and switched between the various beam ports, the switching apparatus to connect a receiver to any one of a plurality of beam ports can be very complicated and expensive. In general, the switching apparatus is more complicated and expensive when more beam ports need to be connected to the receiver. It would, therefore, be desirable to minimize the number of beam ports.

The number of beam ports needed in any system will depend on two factors: the range of angles in which the beam must be steered and the maximum beam width that can be used in the system. For example, in some systems, it may be necessary to distinguish between signals received in directions separated by as little as 10°. In that case, each beam could have a width of no more than 10°. The beam width of the beam corresponding to each beam port is determined by the length of the antenna array. It would seem that the number of beam ports would be the range of angles divided by the maximum allowable beam width. However, this is not the case. The width of each beam is not the same. Beams in directions near the broadside of the antenna are narrower than beams directed off broadside. If the length of the antenna is selected to provide the required beam width for the widest beam, the beams near the broadside of the antenna will be much narrower than required. Consequently, more beams, and more beam ports, are required in directions near broadside of the antenna.

In phased array antennas, phase shifters can be appropriately controlled to ensure that the beam width is the same regardless of the direction in which the beam is steered. However, a phased array antenna is not suitable for use in all systems. For example, where more than one receive beam must be formed simultaneously, a phased array system could be more complicated and expensive than a system using a beam forming lens.

SUMMARY OF THE INVENTION

In light of the foregoing background of the invention, it is an object of this invention to provide a means for producing beams in a plurality of directions, each beam having the same beam width.

It is also an object of this invention to provide a system capable of switching a beam in any direction in a range of values with simplified switching.

The foregoing and other objects of this invention are accomplished with a lens fed array antenna. The back wall of the lens, along which the beam ports are disposed, is not along the focal arc of the lens. Rather, the back wall is displaced from the focal arc by amounts varying from substantially no displacement at the ends to a maximum displacement along the centerline of the lens. The amount of displacement is selected to broaden the broadside beam to have a beam width equal to the width of the beam farthest from broadside.

BRIEF DESCRIPTION OF THE DRAWINGS

The invention may be more fully understood by reference to the following text and accompanying drawings in which.

DESCRIPTION OF THE PREFERRED EMBODIMENT

Figure 1:
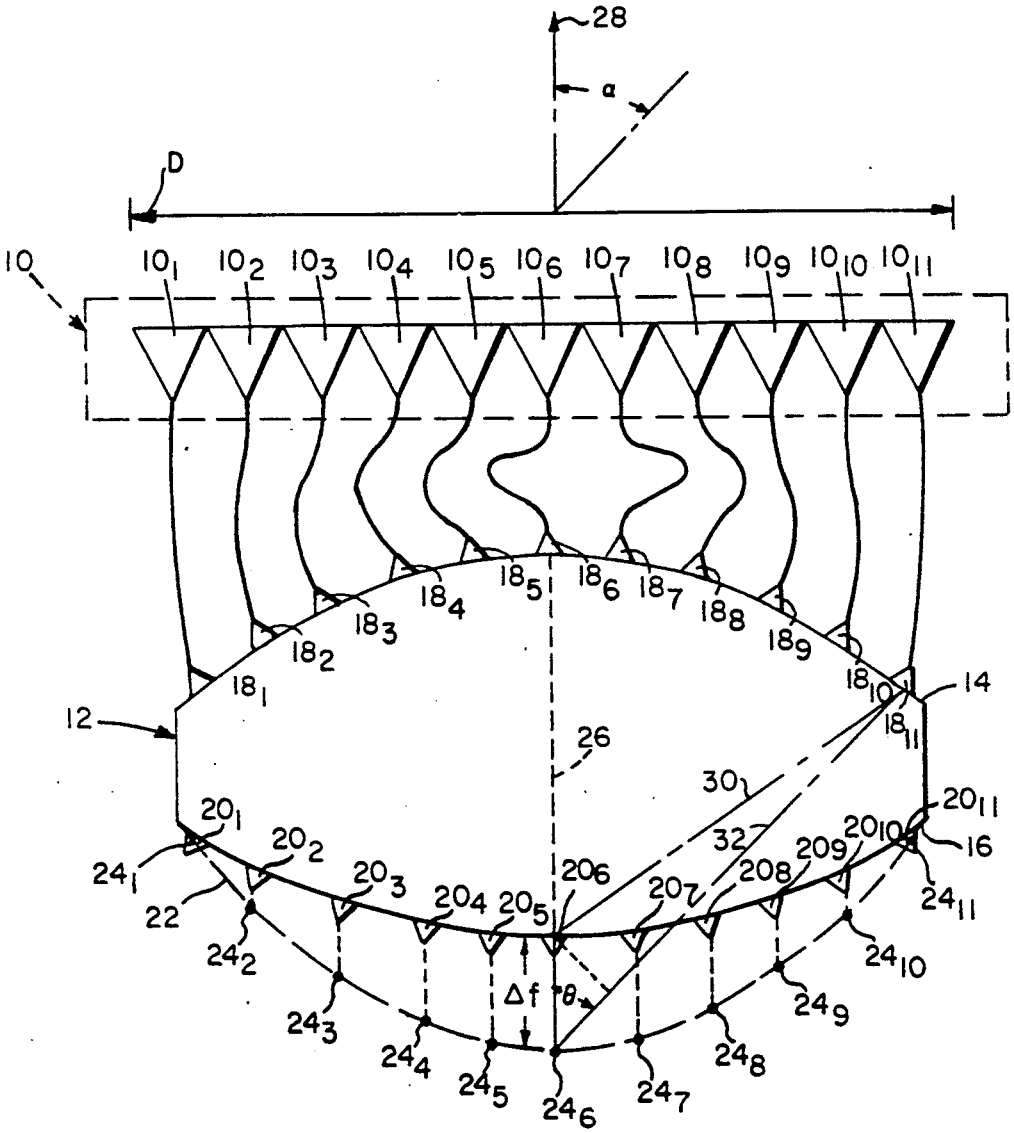
FIG. 1 represents an antenna array and radio frequency lens constructed according to the present invention.

FIG. 1 shows an array antenna 10 and a radio frequency lens 12. One of skill in the art will appreciate that these components could be constructed in many known ways. For example, both lens 12 and array antenna 10 could be fabricated using microstrip technology. If microstrip were used, FIG. 1 would represent the outline of the microstrip conductor. As is known, this conductor is disposed on a dielectric substrate (not shown), which separates the conductor from a ground plane (not shown).

Antenna 10 comprises a plurality of antenna elements $\mathbf{10}_1 \ldots \mathbf{10}_{11}$. Here, eleven antenna elements are shown, but any number could be used. Each antenna element $\mathbf{10}_1 \ldots \mathbf{10}_{11}$ is coupled to a corresponding array port $\mathbf{18}_1 \ldots \mathbf{18}_{11}$ on lens 12. The array ports are disposed along front wall 14 of lens 12. The radius of curvature of front wall 14 is selected according to known electromagnetic lens design techniques.

Arc 22 is the focal arc of lens 12. In traditional lens construction, the beam ports are disposed along the focal arc such as at points $\mathbf{24}_1 \ldots \mathbf{24}_{11}$. According to the invention, beam ports $\mathbf{20}_1 \ldots \mathbf{20}_{11}$ are disposed along back wall 16 of lens 12. As shown in FIG. 1, back wall 16 is displaced from focal arc 22. Here, eleven beam ports are shown, but any number could be used.

As shown in FIG. 1, beam port $\mathbf{20}_6$ is along center line 26 of lens 12. The signal at beam port $\mathbf{20}_6$ corresponds to signals received from an angle along the boresight of antenna 10. Line 28 indicates the direction of the boresight. The angle to which a beam from antenna 10 is transmitted is called the scan angle and denoted $\alpha$. As shown, scan angle $\alpha$ is measured relative to boresight 28.

FIG. 1 shows that beam port $\mathbf{20}_6$ is displaced from the focal arc 22 by an amount $\Delta f$. Beam ports $\mathbf{20}_1$ and $\mathbf{20}_{11}$, at the ends of back wall 16 are on, or nearly on, focal arc 22. Beam ports $\mathbf{20}_1$ and $\mathbf{20}_{11}$ correspond to beams at the maximum scan angle. The displacement of the beam ports $\mathbf{20}_2 \ldots \mathbf{20}_5$ and $\mathbf{20}_7 \ldots \mathbf{20}_{10}$ vary in proportion to the closeness of the beam port to the centerline 26 of the lens.

Displacing a beam port from the focal arc tends to defocus, or broaden, the beam associated with that beam port. Thus, the beam associated with beam port $\mathbf{20}_6$ is broadened the most while the beam associated with beam ports $\mathbf{20}_1$ and $\mathbf{20}_{11}$ are not broadened at all. In this way, the beams from all the beam ports can be made to have the same width by appropriate selection of the displacements of beam ports $\mathbf{20}_1 \ldots \mathbf{20}_{11}$ from the focal arc 22.

The appropriate displacement of each beam port can be calculated using the theory of radio frequency lenses. Well known theory predicts the beam width of any beam when the beam ports are disposed along focal arc 22. The beam width is equal to:

$$BW = k\,\lambda/(D\cos\alpha) \qquad \text{Eq. 1}$$

where BW is the beam width;

k is a constant $\lambda$ is the wavelength of signals received by the antenna;

D is the length of the aperture as shown in FIG. 1; and $\alpha$ is the scan angle of the beam center.

The value of k depends on whether the attenuation in each path from each antenna element $\mathbf{10}_1 \ldots \mathbf{10}_{11}$ through the lens is the same. For the same attenuation, often called "uniform illumination", k equals 51. If the attenuation levels along the paths differ in a cosinusoidal fashion, often called "cosinusoidal illumination", k equals 69. For other patterns of attenuation, methods are known for computing the value of k.

In FIG. 1, locations $\mathbf{24}_1 \ldots \mathbf{24}_{11}$ of beam ports are shown disposed along focal arc 22. These locations are selected according to known techniques based on the angles of the beam centers corresponding to the beam ports. For example, it may be desirable to have beams at angles ranging from $-60°$ to $60°$ in $10°$ increments. The method of selecting the positions of beam port locations to achieve this beam pattern is known.

Using the beam port locations $\mathbf{24}_1 \ldots \mathbf{24}_{11}$ in FIG. 1, the amount each beam port $\mathbf{20}_1 \ldots \mathbf{20}_{11}$ must be displaced to provide equal width beams can be computed starting with Eq. 1. First, the factor by which a beam from a beam port along centerline 26 is to be broadened is computed. In this case, that beam port is beam port $\mathbf{24}_6$. Eq. 1 tells the beam width for beam port $\mathbf{24}_6$. The factor by which the beam associated with beam port $\mathbf{24}_6$ is to be broadened is given by $$\gamma_{DESIRED} = BW_{DESIRED} / BW_6 \qquad \text{Eq. 2}$$

where $BW_6$ is the beam width of the beam corresponding to beam port $\mathbf{24}_6$ as computed in Eq. 1;

$BW_{DESIRED}$ is the desired beam width of the beam; and $\gamma_{DESIRED}$ is the desired beam broadening factor.

For the case shown in FIG. 1, $BW_{DESIRED}$ is the beam width of the broadest beams, here the beams corresponding to beam ports $\mathbf{20}_1$ and $\mathbf{20}_{11}$. Thus, in this case, $BW_{DESIRED}$ is also calculated using Eq. 1.

The desired amount of beam broadening can be achieved by introducing a "quadratic phase error" having a maximum value of $\Delta\Phi_{DESIRED}$. "Quadratic phase error" has the following meaning: Ordinarily, the paths from antenna elements $\mathbf{10}_1 \ldots \mathbf{10}_{11}$ have lengths which ensure that the portions of a signal from a specific angle travelling through the paths reach the beam port all with the same phase. When there is a phase error, the portions of the signal travelling through the various paths arrive at the beam port with different phases. The difference between the phase of the portion of the signal passing through the antenna element in the center of the antenna, here antenna element $\mathbf{10}_6$, and the portion of the signal passing through another antenna element is the phase error of that antenna element. A quadratic phase error implies that the phase errors associated with all the antenna elements describe a quadratic function. The maximum value of phase error would thus occur at the antenna elements at the ends of the array.

Figure 2:
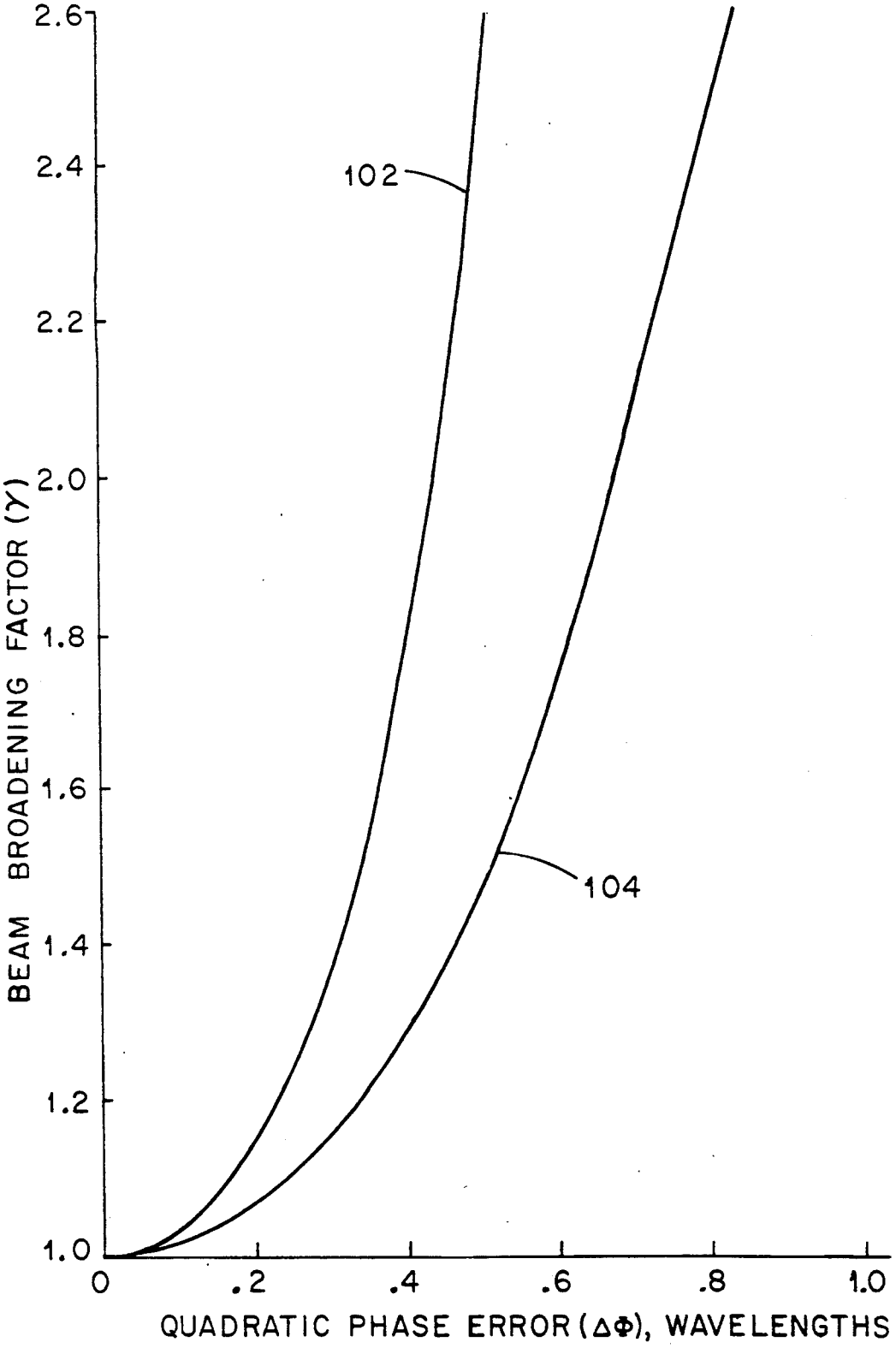
FIG. 2 is a graph useful in understanding how certain dimensions are selected for the lens in FIG. 1.

FIG. 2 shows how the maximum value of quadratic phase error, $\Delta\Phi_{DESIRED}$, can be determined from the calculated value of $\gamma_{DESIRED}$. The ordinate of the graph in FIG. 2 shows beam broadening factors. The abscissa shows the maximum value of the quadratic phase error, in wavelengths, needed to produce the corresponding beam broadening. The graph of FIG. 2 contains values for a linear array as shown in FIG. 1. Curve 102 is used when the aperture is uniformly illuminated. Curve 104 is used when the aperture has a cosinusoidal illumination. Other curves are used for different shaped antennas or different illuminations. These curves can be calculated using known techniques or can be found in the literature.

The value of phase error indicated by the graph of FIG. 2 equals $\Delta\Phi_{DESIRED}$. The value of $\Delta f$, the maximum beam port displacement as shown in FIG. 1, can be computed from $\Delta\Phi_{DESIRED}$. The maximum phase error occurs for the antenna elements at the ends of antenna 10, here antenna element $\mathbf{10}_1$ or $\mathbf{10}_{11}$. The amount of phase error introduced in lens 12 by placing beam port $\mathbf{20}_6$ along back wall 16 instead of focal arc 22 is given by the number of wavelengths difference between the lengths of paths 30 and 32. From geometrical considerations, the phase error is $$\Delta\Phi = \Delta f(1-\cos\theta) \qquad \text{Eq. 3}$$

where $\Delta f$ is the amount beam port $\mathbf{20}_6$ is displaced from focal arc 22; and $\theta$ is the angle as illustrated in FIG. 1.

Using the value of $\Delta\Phi_{DESIRED}$ determined from FIG. 2, the value of $\Delta f$ can be calculated from Eq. 3.

The value of $\Delta f$ dictates the location of beam port $\mathbf{20}_6$. For the lens shown in FIG. 1, the locations of beam ports $\mathbf{20}_1$ and $\mathbf{20}_{11}$ are also known. These beam ports fall on focal arc 22 since the beams corresponding to these beam ports do not need to be broadened. Thus, the location of back wall 16 can be determined by identifying an arc containing beam ports $\mathbf{20}_1$, $\mathbf{20}_6$ and $\mathbf{20}_{11}$.

Once the position of back wall 16 is identified, the placement of the remaining beam ports $\mathbf{20}_2 \ldots \mathbf{20}_5$ and $\mathbf{20}_7 \ldots \mathbf{20}_{10}$ may be determined. Each beam port corresponds to one of the beam port locations $\mathbf{24}_2 \ldots \mathbf{24}_5$ and $\mathbf{24}_7 \ldots \mathbf{24}_{10}$. Each beam port $\mathbf{20}_2 \ldots \mathbf{20}_5$ and $\mathbf{20}_7 \ldots \mathbf{20}_{10}$ is positioned along back wall 16 directly opposite from its corresponding location $\mathbf{24}_2 \ldots \mathbf{24}_5$ or $\mathbf{24}_7 \ldots \mathbf{24}_{10}$. In this case, "opposite" is in the direction of centerline 26.

In this way, it can be seen that the beam broadening is maximum for the central beam associated with beam port $\mathbf{20}_6$ which would otherwise have been the narrowest beam. The beam broadening is a minimum for the beams associated with beam ports $\mathbf{20}_1$ and $\mathbf{20}_{11}$, which otherwise would have been the broadest beams. The beams between the central and end beams are broadened intermediate amounts.

In summary, the following procedure is followed to design the lens of FIG. 1. First, locations of the array ports and beam ports are determined using conventional design techniques. The placements are determined from the number of beams desired and the desired beam width of the broadest beam. The array ports are placed at the computed locations.

Second, the desired amount the central beam needs to be broadened to achieve the desired beam width is determined.

Third, the phase error needed to achieve the desired beam broadening is determined by reference to the graph of FIG. 2.

Fourth, the displacement of the central beam port from the focal arc needed to produce the desired phase error is determined. This displacement establishes the position of the central beam port.

Finally, the back wall of the lens is located by identifying an arc containing the central beam port and the two beam ports furthest removed from the center. The remaining beam ports are then positioned along the back wall opposite the locations computed for beam ports using conventional design techniques.

Having described one embodiment of the invention, numerous alternatives will become obvious to one of skill in the art. As described, the desired location of the center and end beam ports were computed, the desired locations of the rest of the beam ports were approximated. The locations of all of the beam ports could be calculated in a manner similar to the calculation of the desired location of the center beam port.

One of skill in the art could also construct a lens according to the invention where the end beam ports were not located on the focal arc. Rather, the end beam ports could be displaced from the focal arc to broaden the beams associated with those beam ports as well.

What is claimed is:

1. An antenna system comprising:

a) an array antenna;

b) means for introducing a quadratic phase error across the aperture of the antenna, while a beam is being formed by the antenna, a magnitude of the quadratic phase error varying inversely with the scan angle of the beam.

2. The antenna system of claim 1 wherein the means for introducing a quadratic phase error comprises a microwave lens with a plurality of beam ports disposed along an arc displaced from the focal arc of the lens.

3. An antenna system comprising:

a) an antenna having a plurality of elements;

b) a microwave lens having:

i) a plurality of array ports, each one of the array ports coupled to one antenna element, and the array ports disposed along a first wall of the lens;

ii) a plurality of beam ports disposed along a second wall of the lens, said second wall of the lens forming an arc intersecting the focal arc of the lens at a first point and a second point and displaced from the focal arc a predetermined distance at a third point.

4. The antenna system of claim 3 wherein beam ports are disposed at the first point, the second point and the third point.

5. The antenna system of claim 4 wherein the predetermined distance is selected such that the beam corresponding to the beam port at the third point has the same beam width as the beam corresponding to the beam port at the second point.

6. The antenna system of claim 5 wherein the predetermined distance is selected such that the beam corresponding to the beam port at the third point has the same beam width as the beam corresponding to the beam port at the first point.

7. The antenna system of claim 5 wherein the third point is along a center line of the lens.

8. The antenna system of claim 7 wherein the beam ports correspond to beams with different scan angles and the amount each beam port is displaced from the focal arc varies inversely with a scan angle of the corresponding beam.

9. A microwave lens coupled to an array antenna for forming beams, each having a beam width equal to a desired width, said microwave lens made by the method comprising the steps of:

a) identifying locations of the beam ports along the focal arc of the lens to correspond to beams in a plurality of desired angles relative to the broadside direction of the antenna and with the widest beam having a width equal to the desired width;

b) computing the factor by which the narrowest of the beams corresponding to beam ports along the focal arc must be broadened to have a width equal to the desired width;

c) determining the maximum magnitude of the quadratic phase error across the aperture needed to broaden by the computed factor the narrowest beam corresponding to a beam port along the focal arc;

d) determining the placement of the beam port corresponding to the narrowest beam which produces the determined quadratic phase error;

e) identifying a second arc including the determined placement of the beam port corresponding to the narrowest beam and beam ports corresponding to the widest beams; and f) locating beam ports along the second arc opposite the identified locations along the focal arc.

* * * * *